United States Patent [19]

Lewis et al.

[11] 3,932,267

[45] Jan. 13, 1976

[54] PROCESS FOR PRODUCING UNINHIBITED TRANSFORMER OIL

[75] Inventors: Robert William Lewis, Houston; Lawrence Walker Maas, Pasadena, both of Tex.

[73] Assignee: Shell Oil Company, Houston, Tex.

[22] Filed: Sept. 11, 1974

[21] Appl. No.: 505,129

[52] U.S. Cl. ..... 208/87; 208/14; 208/254 H; 208/264

[51] Int. Cl.[2] ..... C10G 34/00

[58] Field of Search ..... 208/14, 18, 87, 254, 264, 208/254 H

[56] References Cited

UNITED STATES PATENTS

| | | | |
|---|---|---|---|
| 2,846,372 | 8/1958 | Schneider et al. | 208/14 |
| 2,865,839 | 12/1958 | Halter et al. | 208/96 |
| 3,196,102 | 7/1965 | Mills et al. | 208/14 |
| 3,406,111 | 10/1968 | Wynkoop et al. | 208/14 |
| 3,551,324 | 12/1970 | Lillard | 208/87 |
| 3,732,154 | 5/1973 | Mills et al. | 208/87 |
| 3,839,188 | 10/1974 | Mills et al. | 208/14 |

*Primary Examiner*—Herbert Levine
*Attorney, Agent, or Firm*—Ronald R. Reper

[57] ABSTRACT

A method for producing uninhibited transformer oil is disclosed which includes isolating a petroleum distillate that is primarily naphthenic and aromatic in character, boiling above 400°F, having a viscosity between 50 and 100 SSU at 100°F, and containing sulfur compounds; contacting the distillate with a solvent selective for aromatic hydrocarbons under conditions to produce a raffinate phase containing 15–30%v aromatic hydrocarbons; hydrotreating the raffinate phase to reduce the nitrogen content to at most 25 PPM, to maintain the sulfur content greater than 0.08%w, and to maintain the aromatic hydrocarbon content greater than 15%v. The product is an uninhibited transformer oil, and it can be further improved by regenerative clay treatment and by the addition of certain aromatic hydrocarbon compounds containing two or more six carbon membered fused or unfused rings, at least one of which is a benzene ring.

5 Claims, No Drawings

PROCESS FOR PRODUCING UNINHIBITED TRANSFORMER OIL

BACKGROUND

Transformer oils are widely used to surround coils in transformers. The transformer oil provides two major functions. The first is as an insulator and the second is as a heat transfer medium to carry heat from the coils to the cooling surfaces of the transformer.

Desirably, when a transformer is filled with transformer oil, it is operated with little or no maintenance or attention. Accordingly, transformer oils must not only have the right properties initially but they must resist change from aging, oxidation, thermal and electrical breakdown, or from other causes. Tranformer oils must also be useful through wide temperature ranges; specifically a transformer oil must have a low enough viscosity at low temperatures to maintain its ability to transfer heat from the transformer coils to the cooling surfaces of the transformer. The breakdown of transformer oil causes it to change its viscosity characteristics, causes it to deposit sludge, and causes it to create gaseous products which create explosion hazards.

The specific properties required in a transformer oil are difficult to attain in a single fluid. The use of additives and inhibitors to obtain these properties is possible, but it is most desirable to employ uninhibited transformer oils. Uninhibited transformer oils have been made by severly treating suitable charge stocks, first with concentrated sulfuric acid and then with clay. The sulfuric acid and clay-treated oils are adequate as transformer oils, but the process produces environmental problems in disposing of spent acid and spent clay. These problems, in fact, are so severe that ecological restrictions prevent the use of acid and nonregenerable clay.

Transformer oil composition is a compromise among various competing influences. For example, pure hydrocarbons are best to obtain good power factor and dielectric strength. For good impulse strength, pure paraffins and naphthenes would be best. For best gassing tendencey, high aromatic content is required, especially multi-ring aromatics. However, for good oxidation stability, naturally occuring sulfur compounds are needed. To obtain an oil meeting all specifications, sacrifices must be made in some properties to obtain adequate performance in others. Blending pure compounds is expensive, so treatments of naturally occurring materials to obtain the properties required for a useful uninhibited transformer oil are of great value.

THE INVENTION

This invention is a process for producing uninhibited transformer oils, which process creates no disposal problem. The method includes isolating a petroleum fraction boiling above 400°F which is primarily naphthenic and aromatic in character, which has a viscosity at 100°F of from 50–100 SSU, and which contains sulfur compounds in amounts greater than about 0.08%w sulfur. This fraction is then contacted with a solvent selective for aromatic hydrocarbon removal at conditions to produce a raffinate phase containing 15–30%v aromatics. Any suitable selective solvent may be used, such as sulfur dioxide, glycol-water solutions, amine-water solutions and others known to the art.

In accordance with the invention, the raffinate phase is then hydrotreated at conditions selected to remove nitrogen to a level less than 25 PPM but to maintain aromatic hydrocarbons at a level of about 15% and greater, and sulfur compounds at a level greater than 0.08%w sulfur. The hydrotreating is effected conventionally under hydrogen pressure and with a conventional catalyst. It is preferred to use a sulfur-resistant catalyst and to maintain a hydrogen sulfide concentration in the hydrogen gas to avoid the removal of sulfur below 0.08%w. Catalytic metals such as nickel, cobalt, tungsten, iron, molybdenum, manganese, platinum, palladium, and combinations of these supported on conventional supports such as alumina, silica, magnesia, and combinations of these with or without acid-acting substances such as halogens and phosphorus may be employed. A particularly preferred catalyst is a nickel molybdenum phosphorus catalyst supported on alumina.

The product from the hydrotreating step is a suitable transformer oil for most conditions. For severe conditions of use, however, the power factor of the product can be further improved by reducing the nitrogen content without otherwise changing the character of the oil. This can be accomplished by regenerative clay treatment which does not adversely affect the ecology because the clay employed may be regenerated and need not be disposed of. Clay treatment is effected by percolating the oil at temperatures from about room temperature 600°F through a suitable material which preferentially absorbs nitrogen compounds such as a particulate aluminum oxide, including, e.g., bauxite or acid activated clays such as attapulgite, montmorillonite, kaolinite and certain halloysites, which when the clay becomes spent may be regenerated by steam stripping to substantially restore its initial capacity for absorbing nitrogen compounds.

It is also within the scope of this invention to improve the gassing properties of the uninhibited transformer oil by adding up to about 5%w of certain aromatic hydrocarbon compounds containing two or more six carbon membered fused or unfused rings at least one of which is a benzene ring, for example, biphenyl.

DETAILED DESCRIPTION OF THE INVENTION

As set forth hereinabove, a suitable transformer oil must have many specific physical, chemical and electrical properties. The physical properties such as its flash point, pour point, viscosity, among others can usually be obtained by selecting a proper petroleum fraction as a process feedstock. For example, selecting a petroleum distillate that is primarily naphthenic and aromatic, and that contains little or no wax and, hence, has a low pour point, and that has an initial boiling point of about 400°F will provide most of the desirable physical properties.

It is also possible to employ a feed distillate oil containing moderate amounts, e.g., up to about 20% paraffinic, i.e., waxy components which paraffinic material may be removed by conventional dewaxing procedures before contacting with the selective solvent, or if desired subsequent to hydrogenation of the raffinate phase. Dewaxing procedures, which are well known in the art conventionally employ chilling the oil, optionally with dilution of a volatile low viscosity solvent such as methyl ethyl and or toluene, to crystallize the wax followed by removal of the waxy material, e.g., by filtration and separation of the solvent, when employed, by conventional fractionation distillation to obtain the dewaxed product oil. Generally speaking increased removal of paraffinic material results in lower pour point (ASTM D-97) of the product oil. The product oil preferably has a pour point of −30°F or lower.

Chemically, the transformer oil should be neutral, free from corrosive materials, and free from materials that would interfere with its physical or electrical properties. The chemical properties of the oil also should be such that it is very stable, particularly it should be stable against oxidation because atmospheric oxygen is constantly available when the oil is in use and it dissolves in the oil and is prone to react with the oil especially when the oil is hot and in contact with catalytic metals such as copper or iron. The electrical properties of the oil must be such that it has high dielectric strength, has good impulse strength and a low power factor. All of the properties discussed above are designed to provide an oil with good electrical properties that will not be lost.

The gasing properties of the uninhibited transformer oil resulting from the process of this invention are completely satisfactory; however, for some applications it may be desirable to further safeguard against gassing tendency by the addition of up to about 5% weight of one or more of certain aromatic hydrocarbon compounds containing two or more six carbon membered fused or unfused rings, at least one of which contains aromatic unsaturation. Examples of these compounds which preferably have atmospheric boiling points in the range from about 400° to 650°F include biphenyl, tetralin, naphthalene, the methyl naphthalenes such as $\alpha$ methyl naphthalene and $\beta$ methyl naphthalene, diphenyl methane, anthracene, phenanthrene and the methyl anthracenes. The desired maximum concentration of any specific compound will depend in part upon the solubility of that compound in the transformer oil at the lowest expected service temperature. Excellent results have been obtained with Biphenyl in amounts up to 2% w, particularly with amounts for 0.5 to 1.0%w. Biphenyl added in that amount substantially reduces the gassing tendencies of an uninhibited transformer oil, which oil still meets all the requirements for a premium quality product. Biphenyl in amounts less than 2%w stays in solution in the transformer oil at low temperatures. The following examples illustrate the process of the present invention and are presented as illustrative rather than limiting on its scope.

EXAMPLE 1

A feed consisting of a vacuum distilled fraction of a California naphthenic crude oil having a viscosity of about 70 SSU at 100°F was employed as a starting material. This fraction had an initial boiling point of 418°F and at 48% overhead had a boiling point of 760°F. The vacuum distillate was extracted with sulfur dioxide under conditions to produce a raffinate containing about 20%w total aromatics, 0.22%w sulfur, 24 PPM nitrogen, and API gravity of 28.3%.

The raffinate fraction described above was hydrotreated over a conventional catalyst consisting of nickel, molybdenum, and phosphorus supported on aluminum oxide. The treatment was effected at 1000 PSIG of hydrogen partial pressure, 1.5/1.0 $H_2$ to feed mole ratio, 1.25–1.4 liquid hourly space velocity (LHSV) and at 525°F. The hydrotreated oil was stripped of hydrogen sulfide, ammonia, water, and light hydrocarbons to give a product having a flash point higher than 295°F. The hydrotreatment left the aromatic content of the raffinate substantially unchanged as to amount and character, but it reduced the sulfur content from 0.22%w to 0.13%w and it reduced the nitrogen content from 24 PPM to 18 PPM. The hydrotreated oil passed all of the physical and chemical specifications described above, and in addition it had an adequate power factor (lower than 0.2), and it strongly passed the oxidation resistance test.

EXAMPLE 2

The raffinate used in Example 1 was hydrotreated under the same conditions except that the temperature was 600°F instead of 525°F. The product properties were such that sulfur was reduced from 0.22 to 0.01%w and nitrogen was reduced from 24 to 1 PPM. Although the power factor of the product was 0.08, well within the specifications, the product badly failed the oxidation test.

EXAMPLE 3

A vacuum distillate fraction of a California napthenic crude having a viscosity of about 70 SSU at about 100°F was extracted with sulfur dioxide under conditions to produce a raffinate containing about 25%w aromatics, 0.28%w sulfur, 85 PPM nitrogen, and having a gravity of 27.4° API. This raffinate was hydrotreated over the catalyst described in Example 1 under the same conditions except that the temperature was 535°F. The product that resulted had its sulfur reduced from 0.28 to 0.11%w, and the nitrogen was reduced from 85 to about 16 PPM. This product had a power factor of 0.12 and it passed marginally the oxidation resistance test.

EXAMPLE 4

The raffinate used in Example 3 was hydrotreated under the same conditions except that the temperature was 500°F instead of 535°F. The sulfur in the product was reduced from 0.28%w to 0.18%w, and the nitrogen in the product was reduced from 85 PPM to 31 PPM. When tested, it was found that this product failed to have an adequate power factor but it passed the oxidation resistance test strongly.

Example 5

A number of tests were run employing both the raffinate of Example 1 and the raffinate of Example 3 at different hydrotreating conditions. In all cases the hydrotreating was effected using the catalyst of Example 1 at 1000 PSIG of hydrogen partial pressure and 1.0–1.4 LHSV but at different temperatures. In the following table, sulfur and nitrogen composition of the feeds, the hydrotreating temperature, the sulfur and nitrogen composition of the product, and the results of power factor and oxidation resistance tests are shown. In each case where the sulfur and nitrogen composition are 0.22 and 24, respectively, the raffinate from Example 1 was employed while each case where the sulfur and nitrogen compositions were 0.28 and 85, respectively, the raffinate of Example 3 was employed.

TABLE I

| Feed | | Hydro-treat | Product | | | |
|---|---|---|---|---|---|---|
| S %W) | N (PPM) | Temp (°F) | S (%W) | N (PPM) | Power Factor | Oxidation Test |
| 0.22 | 24 | 525 | 0.13 | 18 | 0.13 | Strong Pass |

TABLE I-continued

| Feed | | Hydro-treat | Product | | | |
|---|---|---|---|---|---|---|
| S %W) | N (PPM) | Temp (°F) | S (%W) | N (PPM) | Power Factor | Oxidation Test |
| 0.22 | 24 | 600 | 0.01 | 1 | 0.08 | Bad Fail |
| 0.22 | 24 | 496 | 0.16 | 24 | 0.2 (Fail) | Strong Pass |
| 0.22 | 24 | 566 | 0.08 | 17 | 0.08 | Pass |
| 0.28 | 85 | 535 | 0.11 | 16 | 0.12 | Marginal Pass |
| 0.28 | 85 | 500 | 0.18 | 31 | 0.5 (Fail) | Strong Pass |
| 0.28 | 85 | 640 | 0.01 | 3 | 0.05 | Bad Fail |
| 0.28 | 85 | 550 | 0.05 | — | 0.04 | Marginal Fail |

EXAMPLE 6

Example 6 demonstrates the advantage of including hydrogen sulfide in the gas phase during the hydrotreating process. In Example 6, the raffinate described in Example 1 was hydrotreated at 1000 PSIG hydrogen partial pressure, 1.33 LHSV and at 550°F. The oil was treated both in pure hydrogen and in hydrogen containing 5% hydrogen sulfide. In both oils the treatment reduced the nitrogen concentration to yield a power factor of 0.1 or less. The raffinate treated with pure hydrogen had the sulfur content reduced from 0.22 to 0.05 and this oil failed the oxidation resistance test badly. The oil treated with hydrogen containing 5% hydrogen sulfide had its sulfur reduced from 0.22 to 0.10 and it passed its oxidation resistance test strongly.

EXAMPLE 7

This example demonstrates the beneficial effect of regenerative clay treatment of an oil that otherwise is not adequate because it has too high a power factor. The raffinate described in Example 3 was hydrotreated at 1000 PSIG hydrogen pressure at 1.33 LHSV at a temperature of 510°F. The hydrotreated oil had its sulfur content reduced from 0.28 to 0.17. This material passed the oxidation resistance test but failed the power factor test in that it had a power factor of 0.3–0.5. The oil was then percolated over 30–50 mesh bauxite at 1.0 LHSV, at 80°F and in a column having a length to diameter ratio of 16. The percolation was continued to the extent of two barrels of oil per pound of clay. After percolating through the column of clay, the power factor of the oil was 0.5–0.15, well below the 0.2 maximum specification. After the percolation, the clay was completely regenerated by washing with wet steam or by washing with water at 200°–250° F, followed by drying at elevated temperatures. Thus, as demonstrated in Example 7, an oil having adequate properties except for its power factor characteristics can be used as an uninhibited transformer oil after percolating through regenerable clay. The use of such clay does not adversely affect the environment.

EXAMPLE 8

This example demonstrates how the gassing tendency of a transformer oil can be improved by the addition of small amounts of biphenyl. The raffinate described with regard to Example 1 was hydrotreated at 1000 PSIG hydrogen pressure, 1.33 LHSV at a temperature of 538°F. The product was an excellent quality transformer oil meeting all of the specifications. The gassing tendency of the oil was in the 10–15 microliters per minute region which is generally satisfactory. When 0.5%w biphenyl was added to this material, it was found that the gassing tendency dropped from 10–15 microliters per minute to 5 microliters per minute. When 1.0%w biphenyl was added, the gassing tendency dropped to 0. The addition of 1.0%w biphenyl to the oil did not affect any of its other qualities in that it still met all of the requirements for a premium quality uninhibited transformer oil.

What is claimed is:

1. In a method for producing an uninhibited transformer oil comprising:

A. contacting a petroleum distillate oil that is primarily naphthenic and aromatic, boiling higher than about 400°F, having a viscosity of from about 50–100 SSU at 100°F, and containing sulfur compounds of at least about 0.08%wt sulfur with a solvent selective for aromatic hydrocarbons under conditions to produce a raffinate phase containing from 15% to 30%v aromatic hydrocarbons and having a viscosity of from about 55–75 SSU at 100°F, B. contacting the raffinate phase with hydrogen and a hydrogenation catalyst under conditions to i. reduce the nitrogen content thereof to at most 25 PPM, and ii. maintain the aromatic hydrocarbon content thereof greater than 15%v, and C. recovering a transformer oil, the improvement comprising in step B contacting with catalyst is effected to maintain the sulfur content of the raffinate phase greater than 0.1%w.

2. The process of claim 1 wherein up to 5.0%wt on the total mixture of at least one aromatic hydrocarbon selected from the group consisting of biphenyl, tetralin, naphthalene and the methyl naphthalenes is added to said transformer oil, whereby the gassing property of the oil is improved.

3. The process of claim 2 wherein up to 2.0%wt biphenyl is added to said transformer oil.

4. The process of claim 1 wherein at least 3%v hydrogen sulfide is maintained in the vapor phase during contact between the hydrogenation catalyst and raffinate.

5. The process of claim 1 wherein up to 5%wt on the total mixture of at least one aromatic hydrocarbon selected from the group consisting of diphenylmethane, anthracene, phenanthrene and the methyl anthracenes is added to said transformer oil, whereby the gassing property of the oil is improved.

* * * * *